US011571602B1

(12) United States Patent
Krueger

(10) Patent No.: US 11,571,602 B1
(45) Date of Patent: Feb. 7, 2023

(54) HINGED DUMBBELL HOLDER FOR A WEIGHT BENCH

(71) Applicant: Eric Krueger, New London, CT (US)

(72) Inventor: Eric Krueger, New London, CT (US)

( * ) Notice: Subject to any disclaimer, the term of this patent is extended or adjusted under 35 U.S.C. 154(b) by 0 days.

(21) Appl. No.: 17/367,681

(22) Filed: Jul. 6, 2021

(51) Int. Cl.
*A63B 21/072* (2006.01)
*A63B 21/00* (2006.01)

(52) U.S. Cl.
CPC ..... *A63B 21/4029* (2015.10); *A63B 21/0726* (2013.01)

(58) Field of Classification Search
CPC ..... A63B 21/4029; A63B 21/0726; A63B 21/16–1663; F16M 11/2021; A47B 96/061; A47B 57/425; A47B 46/00; A47B 46/005
USPC ..... 248/125.1, 291.1; 211/193, 100, 111
See application file for complete search history.

(56) References Cited

U.S. PATENT DOCUMENTS 4,666,150 A 5/1987 Segrist
5,411,459 A 5/1995 Hayden
5,472,397 A 12/1995 Ammoscato
6,709,370 B1 3/2004 Evans
7,226,400 B1 6/2007 Gedeon-Janvier
7,285,077 B1 10/2007 Marx
D578,173 S 10/2008 James
2016/0107020 A1* 4/2016 Donato ..... A63B 21/0726 482/94
2018/0178051 A1* 6/2018 Shaw, Jr. ..... A63B 21/078
2020/0261759 A1* 8/2020 Downing ..... A63B 21/0783

* cited by examiner

*Primary Examiner* — Joshua Lee

(57) ABSTRACT

The hinged dumbbell holder for a weight bench is configured for use with one or more dumbbells. The hinged dumbbell holder for a weight bench is configured for use with a stanchion of a weight bench. The hinged dumbbell holder for a weight bench attaches to the stanchion of the weight bench. The hinged dumbbell holder for a weight bench forms a supporting structure that elevates the one or more dumbbells above a supporting surface. The hinged dumbbell holder for a weight bench incorporates a mounting bracket, a dumbbell support structure, a hinge, and a rotation assist structure. The stanchion, the dumbbell support structure, the hinge, and the rotation assist structure attach to the mounting bracket. The dumbbell support structure physically receives and elevates the one or more dumbbells. The hinge and the rotation assist structure rotate the dumbbell support structure into a storage position.

13 Claims, 7 Drawing Sheets

HINGED DUMBBELL HOLDER FOR A WEIGHT BENCH

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of strength training including an accessory for a weight bench. (A63B26/00)

SUMMARY OF INVENTION

The hinged dumbbell holder for a weight bench is configured for use with one or more dumbbells. The hinged dumbbell holder for a weight bench is configured for use with a stanchion of a weight bench. The hinged dumbbell holder for a weight bench attaches to the stanchion of the weight bench. The hinged dumbbell holder for a weight bench forms a supporting structure that elevates the one or more dumbbells above a supporting surface. The hinged dumbbell holder for a weight bench comprises a mounting bracket, a dumbbell support structure, a hinge, and a rotation assist structure. The stanchion, the dumbbell support structure, the hinge, and the rotation assist structure attach to the mounting bracket. The dumbbell support structure physically receives and elevates the one or more dumbbells. The hinge and the rotation assist structure rotate the dumbbell support structure into a storage position when the hinged dumbbell holder for a weight bench is not in use.

These together with additional objects, features and advantages of the hinged dumbbell holder for a weight bench will be readily apparent to those of ordinary skill in the art upon reading the following detailed description of the presently preferred, but nonetheless illustrative, embodiments when taken in conjunction with the accompanying drawings.

In this respect, before explaining the current embodiments of the hinged dumbbell holder for a weight bench in detail, it is to be understood that the hinged dumbbell holder for a weight bench is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hinged dumbbell holder for a weight bench.

It is therefore important that the claims be regarded as including such equivalent construction insofar as they do not depart from the spirit and scope of the hinged dumbbell holder for a weight bench. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
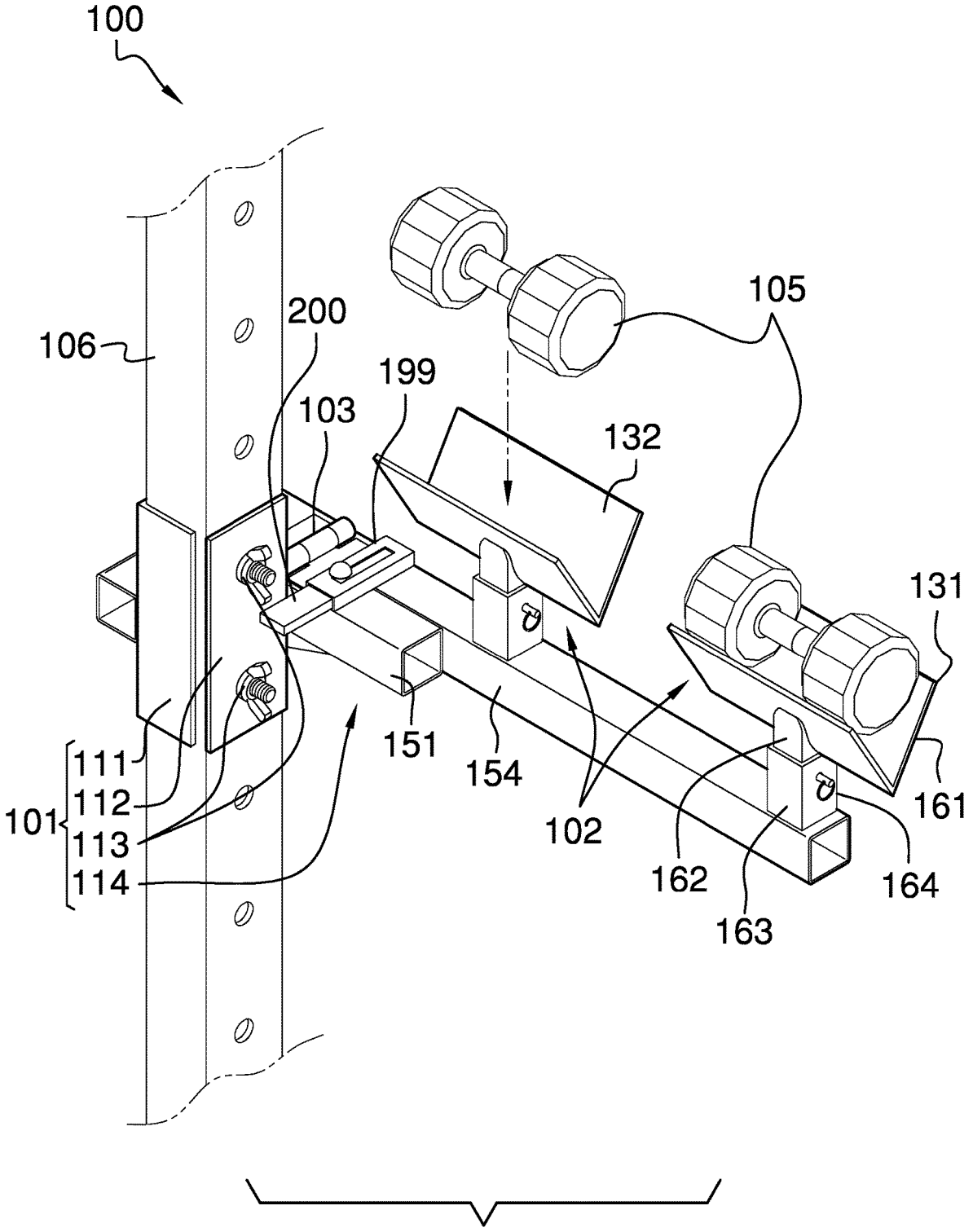
FIG. 1 is a perspective view of an embodiment of the disclosure.
Figure 2:
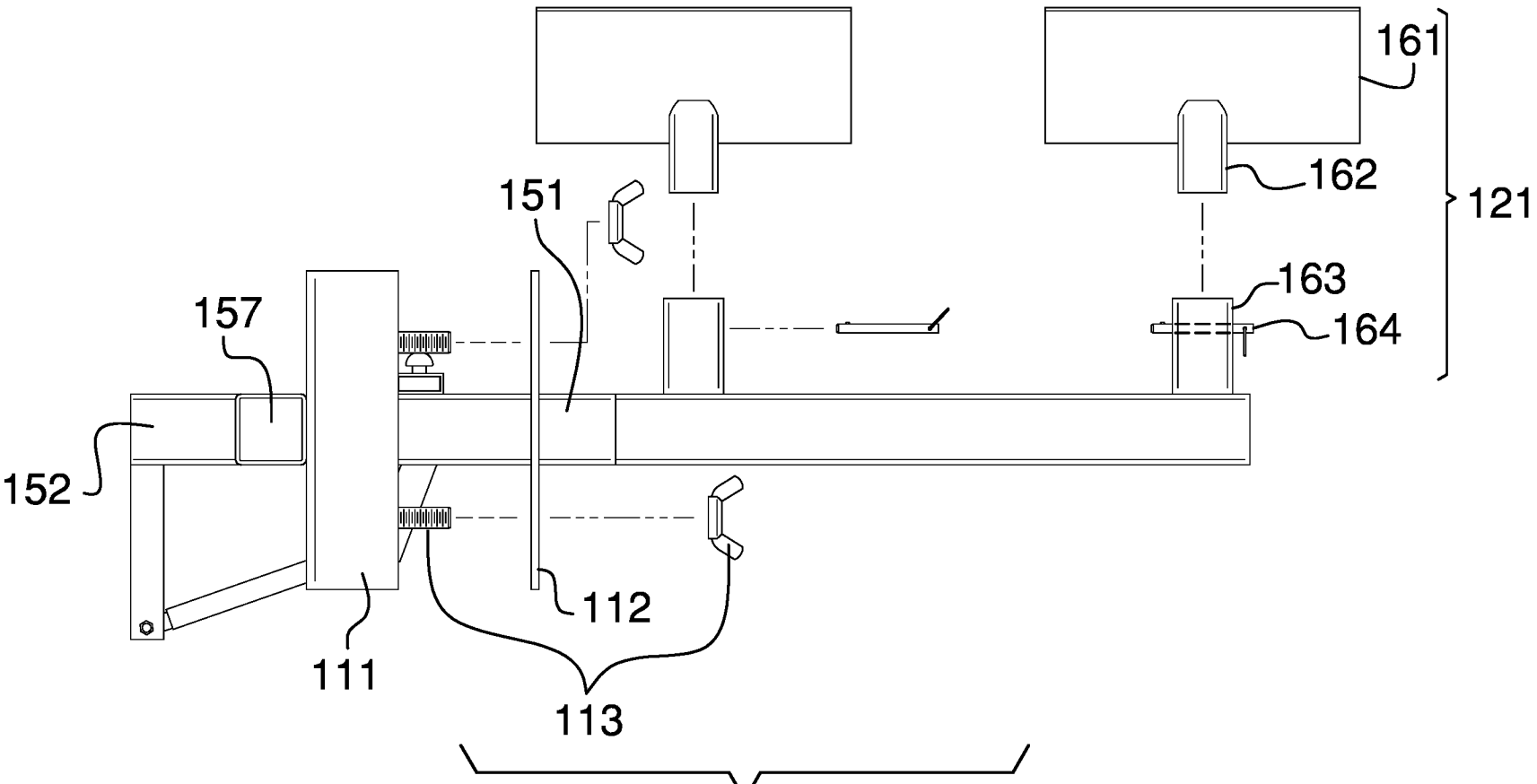
FIG. 2 is a side view of an embodiment of the disclosure.
Figure 3A:
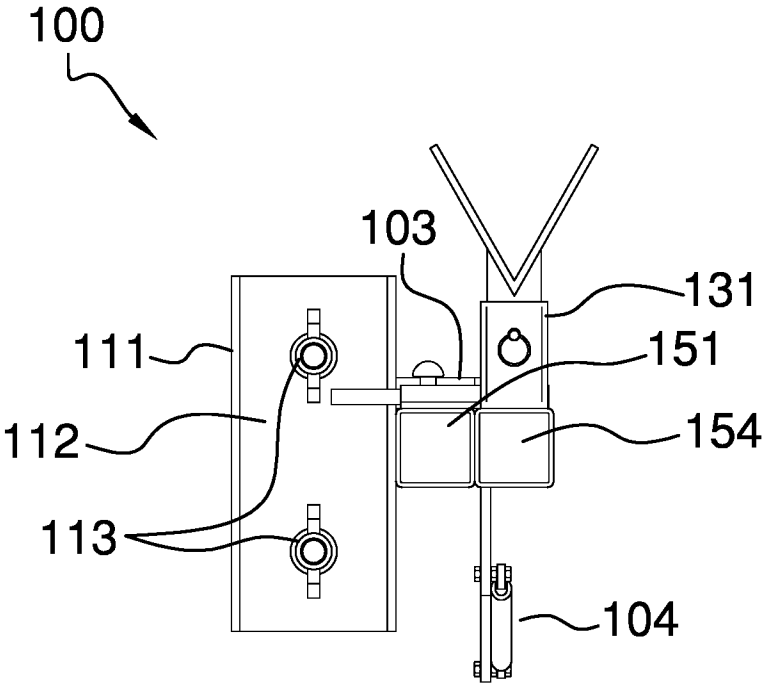
FIG. 3A is an anterior view of an embodiment of the disclosure.
Figure 3B:
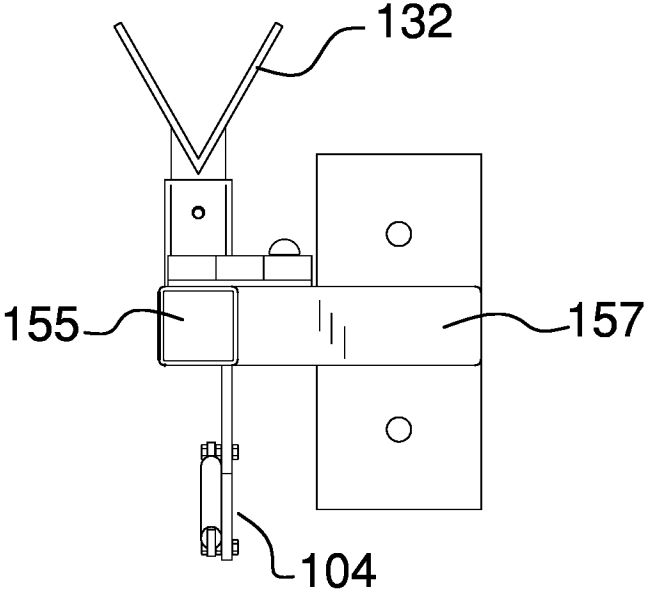
FIG. 3B is a posterior view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 6.

The hinged dumbbell holder for a weight bench 100 (hereinafter invention) is configured for use with one or more dumbbells 105. The invention 100 is configured for use with a stanchion 106 of a weight bench. The invention 100 attaches to the stanchion 106 of the weight bench. The invention 100 forms a supporting structure that elevates the one or more dumbbells 105 above a supporting surface. The invention 100 comprises a mounting bracket 101, a dumbbell 105 support structure 102, a hinge 103, and a rotation assist structure 104. The stanchion 106, the dumbbell 105 support structure 102, the hinge 103, and the rotation assist structure 104 attach to the mounting bracket 101. The dumbbell 105 support structure 102 physically receives and elevates the one or more dumbbells 105. The hinge 103 and the rotation assist structure 104 rotate the dumbbell 105 support structure 102 into a storage position when the invention 100 is not in use.

Each of the one or more dumbbells 105 is a weighted object. Each of the one or more dumbbells 105 is used for strength training. Each of the one or more dumbbells 105 is sized such that any individual dumbbell 105 can be handled and manipulated using a single hand.

The stanchion 106 is a load bearing structure. The stanchion 106 forms a load path that transfers the load of the invention 100 to the supporting surface supporting the weight bench. The stanchion 106 is a perforated square tube structure. The stanchion 106 is oriented such that the center axis of the square tube structure of the stanchion 106 aligns with the vertical direction.

The mounting bracket 101 is a mechanical structure. The mounting bracket 101 physically secures the invention 100 to the stanchion 106. The mounting bracket 101 forms a load path that transfers the load of the dumbbell 105 support structure 102, the hinge 103, the rotation assist structure 104, and the one or more dumbbells 105 to the stanchion 106. The mounting bracket 101 elevates the dumbbell 105 support structure 102 above the supporting surface supporting the weight bench. The mounting bracket 101 comprises a c-channel 111, a flat plate 112, a plurality of bolts and nuts 113, and a mounting platform 114.

The c-channel 111 is a u-shaped mechanical structure. The c-channel 111 is defined elsewhere in the disclosure. The lateral faces of the prism shape of the c-channel 111 are perforated in the manner of a perforated square tube. The c-channel 111 is geometrically similar to the stanchion 106. The span of the length of the inner dimension of the c-channel 111 is greater than the span of the length of the outer dimension of the stanchion 106 such that the stanchion 106 inserts into the c-channel 111.

The flat plate 112 is a perforated flat bar. The flat bar is defined elsewhere in this disclosure. The span of the length of the minor axis of the flat plate 112 is lesser than the span of the length of the inner dimension of the c-channel 111 such that the flat plate 112 will press flush against the stanchion 106 when the stanchion 106 is inserted into the c-channel 111.

Each of the plurality of bolts and nuts 113 is a fastening device comprising a bolt and a wing nut. The bolt, the nut, and the wing nut are defined elsewhere in this disclosure. Each of the plurality of bolts and nuts 113 secures the c-channel 111 and the flat plate 112 to the stanchion 106 such that the stanchion 106 elevates the invention 100 above the supporting surface supporting the weight bench. Each bolt from the plurality of bolts and nuts 113 simultaneously inserts through an aperture formed through the c-channel 111, an aperture formed through the stanchion 106, and an aperture formed through the flat plate 112. Each wing nut selected from the plurality of bolts and nuts 113 screws onto its selected bolt such that the wing nut presses the flat plate 112 tightly against the stanchion 106 such that the invention 100 is securely fastened to the stanchion 106.

The c-channel 111, the flat plate 112, and the plurality of bolts and nuts 113 combine to form the load path that transfers the load of the mounting platform 114, the dumbbell 105 support structure 102, and the one or more dumbbells 105 to the stanchion 106.

The mounting platform 114 is a mechanical structure. The mounting platform 114 attaches to the exterior surface of the lateral face of the c-channel 111 of the mounting bracket 101. The dumbbell 105 support structure 102 attaches to the mounting platform 114. The hinge 103 attaches to the mounting platform 114. The rotation assist structure 104 attaches to the mounting platform 114.

The mounting platform 114 comprises an interior superior anterior square tubing 151, an interior superior posterior square tubing 152, an exterior superior anterior square tubing 154, an exterior superior posterior square tubing 155, and a bracing square tubing 157.

The interior superior anterior square tubing 151 is a prism-shaped structure. The interior superior anterior square tubing 151 is formed as a square tubing. The interior superior posterior square tubing 152 is a prism-shaped structure. The interior superior posterior square tubing 152 is formed as a square tubing. The exterior superior anterior square tubing 154 is a prism-shaped structure. The exterior superior anterior square tubing 154 is formed as a square tubing. The exterior superior posterior square tubing 155 is a prism-shaped structure. The exterior superior posterior square tubing 155 is formed as a square tubing. The bracing square tubing 157 is a prism-shaped structure. The bracing square tubing 157 is formed as a square tubing.

The dumbbell 105 support structure 102 is a mechanical structure. The dumbbell 105 support structure 102 mounts on the mounting platform 114 of the mounting bracket 101. The dumbbell 105 support structure 102 physically receives the one or more dumbbells 105 for temporary storage on the weight bench. The dumbbell 105 support structure 102 physically elevates the one or more dumbbells 105 above the supporting surface supporting the weight bench. The dumbbell 105 support structure 102 comprises a collection of individual db supports 121.

Each individual db support 121 is a structure that receives an individual dumbbell 105. Each individual db support 121 is identical. Each individual db support 121 receives an individual dumbbell 105 selected from the one or more dumbbells 105. Each individual db support 121 elevates the individual dumbbell 105 selected from the one or more dumbbells 105 above the supporting surface supporting the weight bench. The individual db support 121 transfers the load of the supported individual dumbbell 105 to the mounting platform 114 for transfer to the stanchion 106. The individual db support 121 further comprises a db support plate 161, a db mounting tenon 162, a db mounting mortise 163, and a cotterless pin 164.

The db support plate 161 is a chevron shaped structure. The db support plate 161 forms the supporting surface on which an individual dumbbell 105 selected from the one or more dumbbells 105 rests when the dumbbell 105 support structure 102 is in a deployed position.

The db mounting tenon 162 is a perforated square tube structure that attaches to the interior surface of the db support plate 161. The db mounting tenon 162 forms a tenon that secures the db support plate 161 to the db mounting mortise 163. The db mounting tenon 162 is geometrically similar to the db mounting mortise 163 such that the db mounting tenon 162 inserts into the db mounting mortise 163.

The db mounting mortise 163 is a perforated square tube structure that attaches to the superior surface of the exterior superior anterior square tubing 154. The db mounting tenon 162 forms a mortise that secures the db support plate 161 and the db mounting tenon 162 to the db mounting mortise 163. The db mounting mortise 163 is geometrically similar to the db mounting tenon 162 such that the db mounting tenon 162 inserts into the db mounting mortise 163 to attach the db support plate 161 to the exterior superior anterior square tubing 154 of the mounting platform 114.

The cotterless pin 164 is a prism-shaped structure. The cotterless pin 164 is defined elsewhere in this disclosure. The cotterless pin 164 simultaneously inserts through the db mounting tenon 162 and the db mounting mortise 163 to secure the db support plate 161 to the mounting platform 114.

The dumbbell 105 support structure 102 further comprises an anterior db support 131 and a posterior db support 132. The anterior db support 131 is the individual db support 121 that mounts on the superior surface of the exterior superior anterior square tubing 154 of the mounting platform 114. The anterior db support 131 is the individual db support 121 of the dumbbell 105 support structure 102 that is distal from the hinge 103. The posterior db support 132 is the individual db support 121 that mounts on the superior surface of the exterior superior anterior square tubing 154 of the mounting platform 114. The posterior db support 132 is the individual db support 121 of the dumbbell 105 support structure 102 that is proximal to the hinge 103. The posterior db support 132 is identical to the anterior db support 131.

The hinge 103 is a rotating structure. The hinge 103 attaches to the mounting platform 114 of the mounting bracket 101 such that the dumbbell 105 support structure 102 can be rotated to a storage position.

The rotation assist structure 104 is a mechanical structure. The rotation assist structure 104 is a mechanical linkage that attaches the exterior superior anterior square tubing 154 to the exterior superior posterior square tubing 155. The rotation assist structure 104 is a hydraulic cylinder. The rotation assist structure 104 stores rotational energy generated by the rotation of the exterior superior anterior square tubing 154 of the mounting bracket 101 from the storage position of the dumbbell 105 support structure 102 to the deployment position of the dumbbell 105 support structure 102. The rotation assist structure 104 compresses to store the rotational energy when the dumbbell 105 support structure 102 is rotated to a deployed position. The energy released by the return of the hydraulic cylinder structure of the rotation assist structure 104 to its relaxed shape provides motive forces that assist rotating the dumbbell 105 support structure 102 back to its storage position. The rotation assist structure 104 mounts on the mounting bracket 101.

Figure 4:
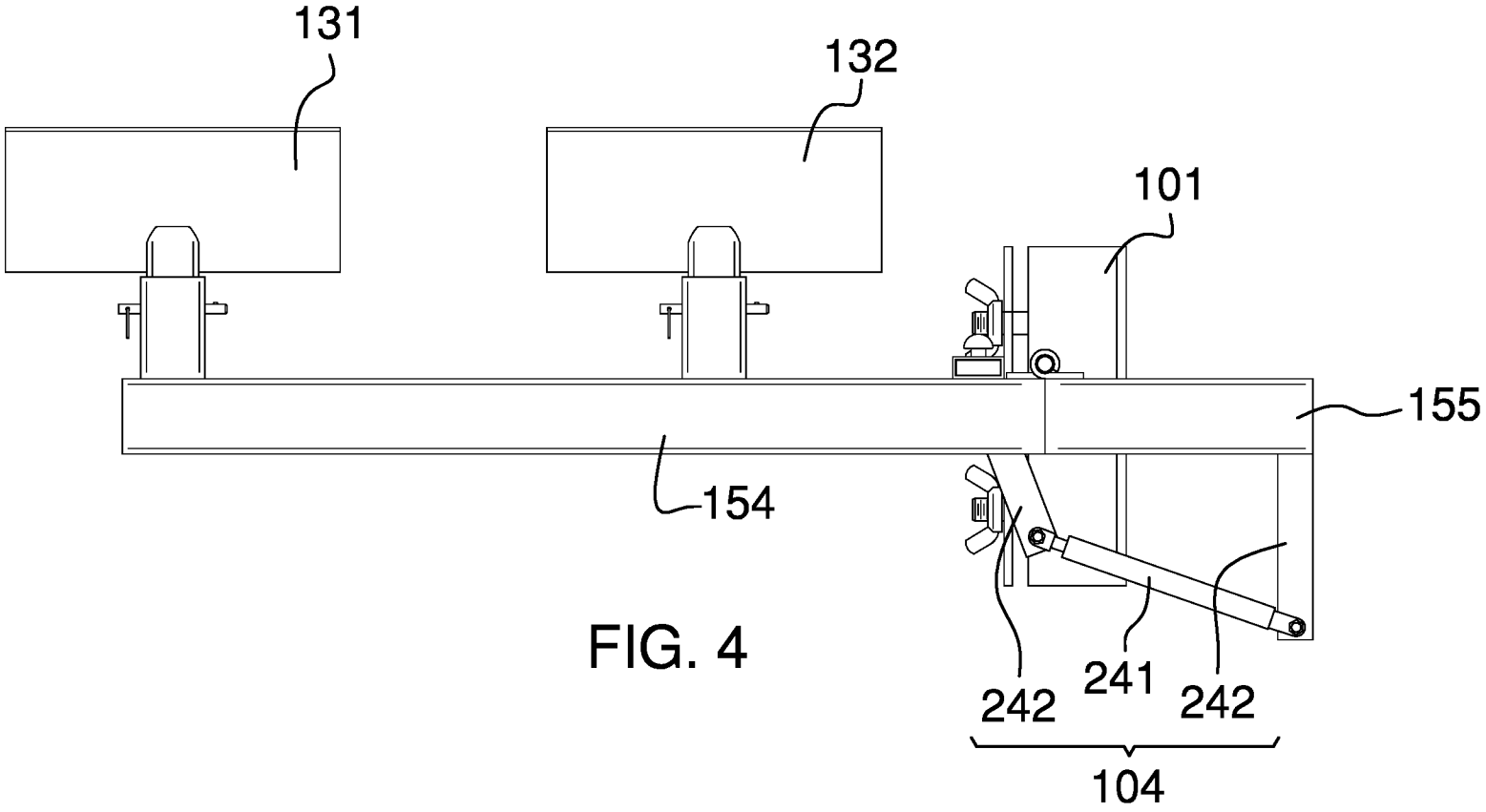
FIG. 4 is a reverse side view of an embodiment of the disclosure.
Figure 5:
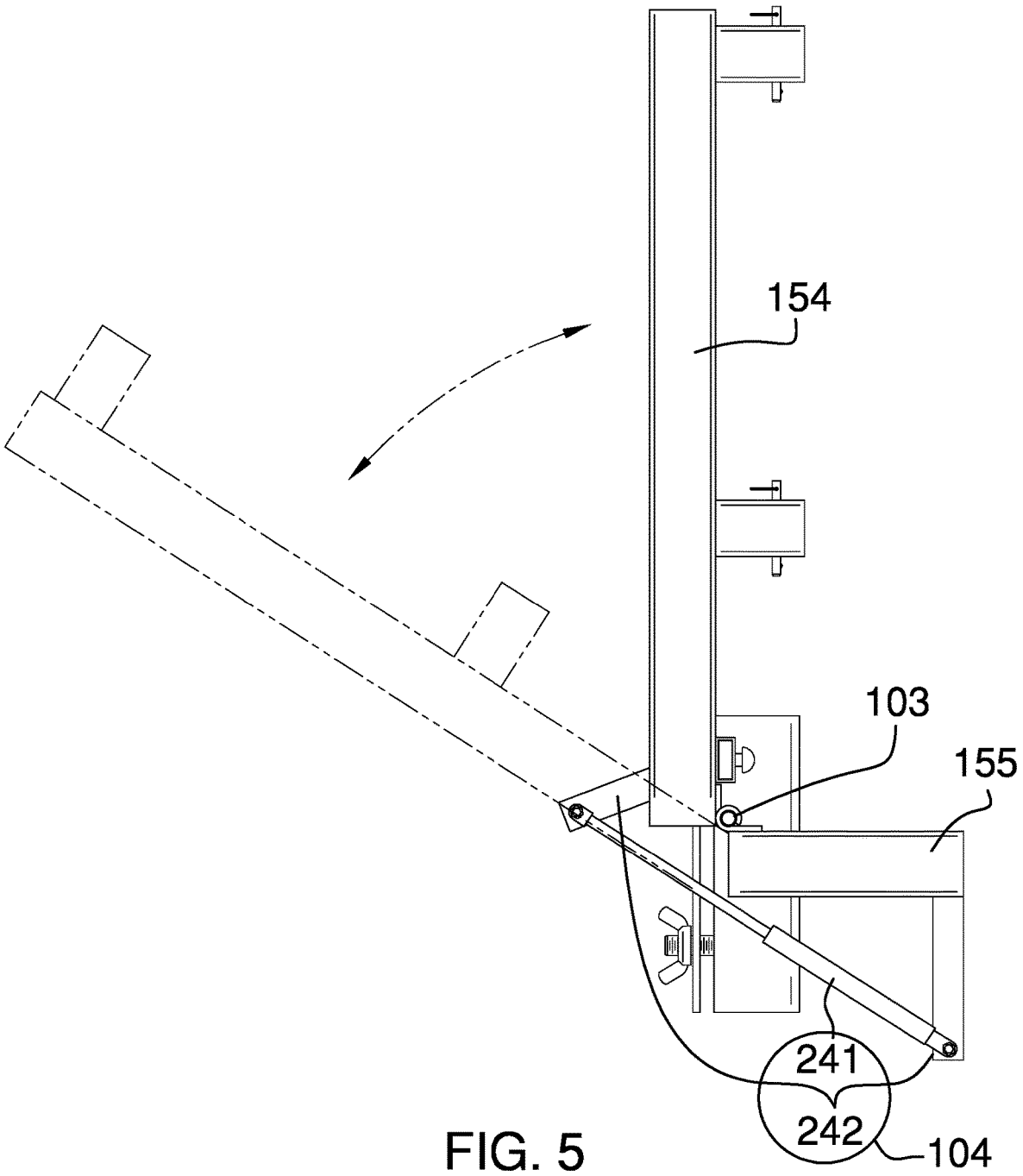
FIG. 5 is a reverse side view of an embodiment of the disclosure.
Figure 6:
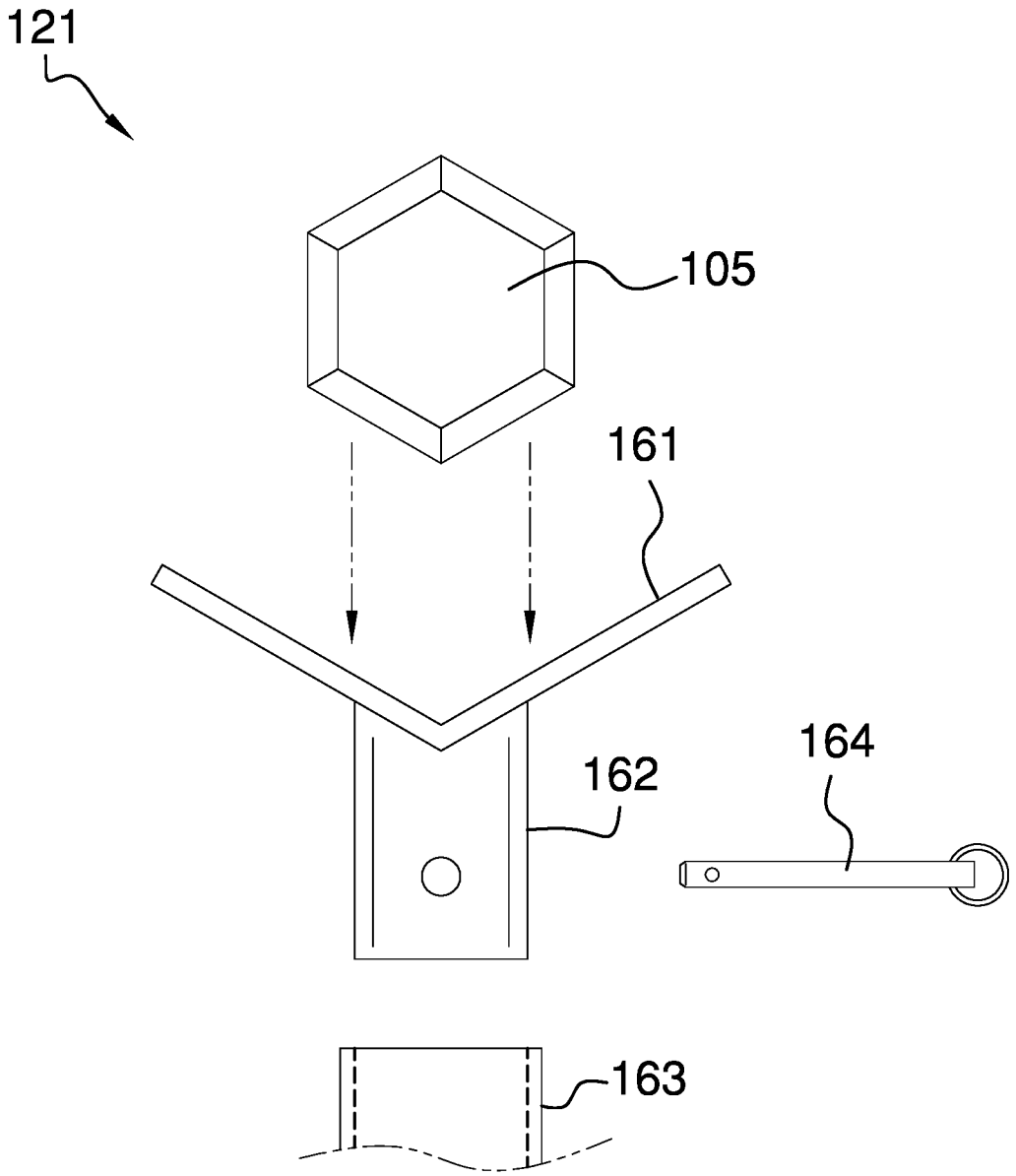
FIG. 6 is a detail view of an embodiment of the disclosure.

As shown in FIGS. 4 and 5, the rotation assist structure 104 further comprises a hydraulic cylinder 241 and a cylinder mounting structure 242. The cylinder mounting structure 242 rigidly secures the hydraulic cylinder 241 to the exterior superior anterior square tubing 154 to the exterior superior posterior square tubing 155.

The following five paragraphs describe the assembly of the mounting platform 114 of the mounting bracket 101.

The interior lateral face of the interior superior anterior square tubing 151 lies next to but does not attaches to the exterior lateral face of the c-channel 111 to form an offset lateral prism structure. The exterior lateral face of the interior superior anterior square tubing 151 attaches to the interior lateral face of the exterior superior anterior square tubing 154 to form a lateral prism structure. The span of the length of the center axis of the interior superior anterior square tubing 151 is less than the span of the length of the center axis of the exterior superior anterior square tubing 154.

The inferior lateral face of the interior superior posterior square tubing 152 attaches to the superior lateral face of the bracing square tubing 157 to form an offset lateral prism structure. The hinge 103 attaches the superior lateral face of the interior superior anterior square tubing 151 to the superior lateral face of the interior superior posterior square tubing 152 such that the interior superior anterior square tubing 151 rotates relative to the interior superior posterior square tubing 152. The hinge 103 secures the interior superior anterior square tubing 151 to the interior superior posterior square tubing 152 such that the interior superior anterior square tubing 151 and the interior superior posterior square tubing 152 form a composite prism structure.

The interior lateral face of the exterior superior anterior square tubing 154 attaches to the exterior lateral face of the interior superior anterior square tubing 151 to form a lateral prism structure. The dumbbell 105 support structure 102 mounts on the superior lateral face of the exterior superior anterior square tubing 154.

The inferior lateral face of the exterior superior posterior square tubing 155 attaches to the superior lateral face of the bracing square tubing 157 to form an offset lateral prism structure. The interior lateral face of the exterior superior posterior square tubing 155 attaches to the exterior lateral face of the interior superior posterior square tubing 152 to form a lateral prism structure. The hinge 103 attaches the superior lateral face of the exterior superior anterior square tubing 154 to the superior lateral face of the exterior superior posterior square tubing 155 such that the exterior superior anterior square tubing 154 rotates relative to the exterior superior posterior square tubing 155. The hinge 103 secures the exterior superior anterior square tubing 154 to the exterior superior posterior square tubing 155 such that the exterior superior anterior square tubing 154 and the exterior superior posterior square tubing 155 form a composite prism structure.

The superior surface of the bracing square tubing 157 attaches to the inferior lateral face of the interior superior posterior square tubing 152 to form an offset lateral prism structure. The superior surface of the bracing square tubing 157 attaches to the inferior lateral face of the exterior superior posterior square tubing 155 to form an offset lateral prism structure. A lateral face of the bracing square tubing 157 attaches to the exterior lateral face of the c-channel 111 to form an offset lateral prism structure.

The invention 100 may include a latch 199. The latch 199 is mounted to the exterior superior anterior square tubing 154. The latch 199 includes a latch arm 200 that extends to engage the mounting bracket 101 in order to lock the invention 100 so that the hinge 103 may not rotate.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Anterior: As used in this disclosure, anterior is a term that is used to refer to the front side or direction of a structure. When comparing two objects, the anterior object is the object that is closer to the front of the structure.

Bolt: As used in this disclosure, a bolt is a cylindrical shaft that is formed with an exterior screw thread. A bolt is defined with an outer diameter.

Bolt Hole: As used in this disclosure, a bolt hole is a prism-shaped disk that is formed with a cylindrical negative space that allows a shaft to be inserted through the faces of the disk. A bolt hole is further defined with an inner diameter. See Recess Brace: As used in this disclosure, a brace is a structural element that is used to support, stabilize, or otherwise steady an object.

C-Channel: As used in this disclosure, the C-channel is a load bearing structure, such as a beam, that is formed in a U-shape. The C-channel forms a prism shape with a hollow interior and an open lateral face that forms a shape characteristic of the letter C when viewed from the congruent ends. The open space of the C-channel is often used as a track. A C-channel is a U-shaped structure.

Cant: As used in this disclosure, a cant is an angular deviation from one or more reference lines (or planes) such as a vertical line (or plane) or a horizontal line (or plane).

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axis of two cylinder, prism or pyramidal structures share the same line they are said to be aligned. When the center axis of two cylinder, prism or pyramidal structures do not share the same line they are said to be offset.

Chevron: As used in this disclosure, chevron is a term that is used to describe an object that has the shape of a U or a V.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axis of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Cotterless Pin: As used in this disclosure, a cotterless pin is a metal shaft that is used to hold two mechanical components together. The cotterless pin typically simultaneously inserts through two holes, one formed in each of the mechanical components.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Diametrically Opposed: As used in this disclosure, diametrically opposed is a term that describes the locations of a first object and a second object located at opposite ends of a diameter drawn through a third object. The term diametric opposition can also be used to describe this relationship.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Distal: As used in this disclosure, distal refers to a directional sense or location of an object. Specifically, distal refers to a first object, or a side of a first object, that is distal from the medial axis, or more proximal to the side of the object, relative to a second object, or side of a second object.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space. In this disclosure, an interior surface is the surface of that is distal from the stanchion.

Exterior Screw Thread: An exterior screw thread is a ridge wrapped around the outer surface of a tube in the form of a helical structure that is used to convert rotational movement into linear movement.

Flat Bar: As used in this disclosure, a flat bar is a metal rectangular disk structure. The span of the length of the major axis of a traditional flat bar is significantly longer than the span of the length of the minor axis of the flat bar. By significantly longer is meant the ratio of the span of the length of the major axis to the span of the length of the minor flat is greater than or equal to 8. A flat bar structure with a length ratio of less than eight is referred to as a short flat bar. A punched flat bar is a flat bar that has a plurality of apertures that are formed through the faces of the disk structure of the flat bar. A punched flat bar is often called a perforated flat bar. Generally, the center points of the plurality of apertures of a punched flat bar are aligned to be parallel to the major axis of the flat bar. The flat bar is commonly used as a structural element. The flat bar is a readily and commercially available product. The flat bar is also referred to as a flat iron.

Flush: As used in this disclosure, the term flush is used to describe the alignment of a first surface and a second surface to form a single structure selected from the group consisting of a Euclidean plane and a non-Euclidean plane.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

High Strength Steel: As used in this disclosure, a high strength steel is a commercially available steel (commonly a steel alloy) that is considered suitable for use in applications such as the construction of buildings, the manufacturing of cranes, military armor, and other applications where the steel is expected to bear large loads. Commercially available steels that are marketed as A514 or A517 steels would be considered suitable for use as a high strength steels within this definition.

Helix: As used in this disclosure, a helix is the three-dimensional structure that would be formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute.

Hinge: As used in this disclosure, a hinge is a device that permits the turning, rotating, or pivoting of a first object relative to a second object. A hinge designed to be fixed into a set position after rotation is called a locking hinge. A spring loaded hinge is a hinge formed as an elastic structure. The elastic structure of the spring loaded hinge is deformed under a rotating force such that the elastic structure returns the spring loaded hinge back to its relaxed shape after the rotating force is removed from the spring loaded hinge.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Hydraulic: As used in this disclosure, hydraulic refers to a device wherein the movement of the device is powered using a fluid under pressure. The terms pneumatic and hydraulic can be used interchangeably.

Hydraulic Cylinder: As used in this disclosure, a hydraulic cylinder is a telescopic composite prism structure comprising an outer cylinder (or other tubular prism structure) and a matching piston structure. The piston structure mounts in the outer cylinder such that the position of the piston structure within the outer cylinder structure of the hydraulic cylinder is adjustable. The combination of the outer cylinder and the piston structure forms a reservoir within the hydraulic cylinder that contains a fluid, referred to as a hydraulic fluid. The reservoir forms a variable containment volume structure. The pressure of the hydraulic fluid contained within the reservoir varies as a function of the containment volume of the hydraulic cylinder. This arrangement allows for the adjustment of the piston position by applying an external force to change the pressure of the hydraulic fluid contained in the reservoir. Alternately, the pressure of the hydraulic fluid in the reservoir can be adjusted applying an external force to change the position of the piston structure within the outer cylinder.

Inferior: As used in this disclosure, the term inferior refers to a directional reference that is parallel to and in the same direction as the force of gravity when an object is positioned or used normally.

Inner Dimension: As used in this disclosure, the term inner dimension describes the span from a first inside or interior surface of a container to a second inside or interior surface of a container. The term is used in much the same way that a plumber would refer to the inner diameter of a pipe.

Interior: As used in this disclosure, the interior is used as a relational term that implies that an object is contained within the boundary of a structure or a space. In this disclosure, an interior surface is the surface of that is proximal to the stanchion.

Interior Screw Thread: An interior screw thread is a groove that is formed around the inner surface of a tube in the form of a helical structure that is used to convert rotational movement into linear movement.

Lateral: As used in this disclosure, the term lateral refers to an axis of an object that is perpendicular in the transverse (posterior to anterior) direction and the sagittal (superior to inferior) direction. The distal surfaces of an object that intersect the lateral axis are often informally referred to as the "sides" of the object. The lateral axis is usually perpendicular to the primary sense of direction of the object. A lateral face refers to the surfaces of a prism structure that run between the congruent ends of the prism. Movement in a lateral direction is often called "sideways" movement.

Lateral Prism Structure: As used in this disclosure, a lateral prism structure refers to the juxtaposition of a first lateral face of a first prism structure to a second lateral face of a second prism structure such that: a) the center axis of the first prism and the second prism are parallel; and, b) the congruent ends of the first prism are parallel to the congruent ends of the second prism. The span of the length of the center axis of the first prism and the second prism need not be equal. The form factor of the congruent ends of the first prism and the second prism need not be geometrically similar.

Major and Minor Axis: As used in this disclosure, the major and minor axis refer to a pair of perpendicular axis that are defined within a structure. The length of the major axis is always greater than or equal to the length of the minor axis. The major axis is always the longest diameter of the structure. The major and minor axis intersect at the center of the structure. The major axis is always parallel to the longest edge of a rectangular structure.

Mass: As used in this disclosure, refers to a quantity of matter within a structure. Mass is measured and quantified by the reaction of the structure to a force. Mass can also be roughly quantified as a function of atomic composition and the number of atoms contained within the structure. The term weight refers to the quantification of a mass that is exposed to the force of gravity.

Mechanical Linkage: As used in this disclosure, a mechanical linkage is an interconnected arrangement of components that are used to manage the transfer of a movement or a force. A mechanical linkage is often referred to as a linkage.

Mortise: As used in this disclosure, a mortise is a prism-shaped negative spaced formed in an object that is designed to receive a geometrically similar object referred to as a tenon.

Negative Space: As used in this disclosure, negative space is a method of defining an object through the use of open or empty space as the definition of the object itself, or, through the use of open or empty space to describe the boundaries of an object.

Nut: As used in this disclosure, a nut is a first object that is formed with a cylindrical negative space that further comprises an interior screw thread such that a second object with a matching exterior screw thread can screwed into the first object forming a threaded connection. A nut is further defined with an inner diameter.

Offset Lateral Prism Structure: As used in this disclosure, an offset lateral prism structure refers to the juxtaposition of a first lateral face of a first prism structure to a second lateral face of a second prism structure in the manner of a lateral prism structure except that one or more of the following conditions need not be true: a) the center axis of the first prism and the second prism are no longer parallel; and, b) the congruent ends of the first prism are no longer parallel to the congruent ends of the second prism.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

Perimeter: As used in this disclosure, a perimeter is one or more curved or straight lines that bounds an enclosed area on a plane or surface. The perimeter of a circle is commonly referred to as a circumference.

Piston: As used in this disclosure, a piston is a prism, disk, or shaft that fits closely in a housing and that moves along its center axis Posterior: As used in this disclosure, posterior is a term that is used to refer to the side of an object that is distal or in the opposite direction of the anterior side. When comparing two items, the posterior item is the item that is distal from the anterior of the object.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder. Screw: As used in this disclosure, to screw is a verb meaning: 1) to fasten or unfasten (unscrew) a threaded connection; or 2) to attach a helical structure to a solid structure.

Radial: As used in this disclosure, the term radial refers to a direction that: 1) is perpendicular to an identified central axis; or, 2) projects away from a center point.

Rotation: As used in this disclosure, rotation refers to the cyclic movement of an object around a fixed point or fixed axis. The verb of rotation is to rotate.

Screw: As used in this disclosure, to screw is a verb meaning: 1) to fasten or unfasten (unscrew) a threaded connection; or 2) to attach a helical structure to a solid structure.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Square Tubing: Square Tubing: As used in this disclosure, square tubing is a square prism-shaped structure. The square tubing forms a hollow tubular structure. The square tubing is a metal structure that is commonly used for structural purposes. The term punched square tubing refers to a square tubing with a plurality of diametrically opposed aperture pairs formed through the lateral faces of the prism structure of the square tubing. The punched square tubing is often referred to as a perforated square tubing.

Stanchion: As used in this disclosure, a stanchion refers to a vertically oriented prism-shaped pole, post, or support.

Such As: As used in this disclosure, the term "such as" is a conjunction that relates a first phrase to a subsequent phrase. The term "such as" is used to introduce representative examples of structures that meet the requirements of the first phrase. As a first example of the use of the term "such as," the phrase: "the first textile attaches to the second textile using a fastener such as a hook and loop fastener" is taken to mean that a hook and loop fastener is suitable to use as the fastener but is not meant to exclude the use of a zipper or a sewn seam. As a second example of the use of the term "such as," the phrase: "the chemical substance is a halogen such as chlorine or bromine" is taken to mean that either chlorine or bromine are suitable for use as the halogen but is not meant to exclude the use of fluorine or iodine.

Such That: As used in this disclosure, the term "such that" is a conjunction that relates a first phrase to a subsequent phrase. The term "such that" is used to place a further limitation or requirement to the first phrase. As a first example of the use of the term "such that," the phrase: "the door attaches to the wall such that the door rotates relative to the wall" requires that the attachment of the door allows for this rotation. As a second example of the use of the term "such that," the phrase: "the chemical substance is selected such that the chemical substance is soluble in water" requires that the selected chemical substance is soluble in water. As a third example of the use of the term "such that," the phrase: "the lamp circuit is constructed such that the lamp circuit illuminates when the lamp circuit detects darkness" requires that the lamp circuit: a) detect the darkness; and, b) generate the illumination when the darkness is detected.

Superior: As used in this disclosure, the term superior refers to a directional reference that is parallel to and in the opposite direction of the force of gravity when an object is positioned or used normally.

Tenon: As used in this disclosure, a tenon is a prism-shaped structure that fits into a mortise such that the tenon attaches to the mortise. The tenon is geometrically similar to the mortise.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Torque: As used in this disclosure, a torque refers to a force that causes an object to rotate.

Tube: As used in this disclosure, the term tube is used to describe a rigid hollow prism-shaped device with two congruent open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

U-Shaped Structure: As used in this disclosure, a U-shaped structure refers to a three-sided structure comprising a crossbeam, a first arm, and a second arm. In a U-shaped structure, the first arm and the second arm project away from the crossbeam: 1) in the same direction; 2) at a roughly perpendicular angle to the crossbeam, and, 3) the span of the length of the first arm roughly equals the span of the length of the second arm. The first arm and the second arm project away from the crossbeam in the manner of a cantilever. An illiterate U-shaped structure is a U-shaped structure where the span of the length of the first arm does not equal the span of the length of the second arm.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Wing Nut: As used in this disclosure, a wing nut is a nut that is formed with a plurality of grips that allows the wing nut to be screwed onto a bolt by hand.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A strength training accessory comprising a mounting bracket, a dumbbell support structure, a hinge, and a rotation assist structure;

wherein a stanchion, the dumbbell support structure, the hinge, and the rotation assist structure attach to the mounting bracket;

wherein the dumbbell support structure comprises a collection of individual db supports;

wherein each individual db support is identical;

wherein each individual db support receives an individual dumbbell selected from one or more dumbbells;

wherein each individual db support elevates the individual dumbbell selected from the one or more dumbbells above a supporting surface supporting a weight bench;

wherein each individual db support transfers a load of the supported individual dumbbell to a mounting platform for transfer to the stanchion.

2. The strength training accessory according to claim 1 wherein the strength training accessory is configured for use with the one or more dumbbells;

wherein the strength training accessory is configured for use with the stanchion of a weight bench;

wherein the strength training accessory attaches to the stanchion of the weight bench;

wherein each of the one or more dumbbells is a weighted object;

wherein each of the one or more dumbbells is used for strength training;

wherein the strength training accessory forms the supporting structure that elevates the one or more dumbbells above the supporting surface;

wherein the stanchion is a load bearing structure;

wherein the stanchion forms a load path that transfers the load of the strength training accessory to the supporting surface supporting the weight bench;

wherein the stanchion is a perforated square tube structure;

wherein the stanchion is oriented such that a center axis of the square tube structure of the stanchion aligns with the vertical direction;

wherein the dumbbell support structure physically receives and elevates the one or more dumbbells;

wherein the hinge and the rotation assist structure rotates the dumbbell support structure into a storage position.

3. The strength training accessory according to claim 2 wherein the mounting bracket is a mechanical structure;

wherein the mounting bracket physically secures the strength training accessory to the stanchion;

wherein the mounting bracket forms a load path that transfers the load of the dumbbell support structure, the hinge, the rotation assist structure, and the one or more dumbbells to the stanchion;

wherein the mounting bracket elevates the dumbbell support structure above the supporting surface supporting the weight bench.

4. The strength training accessory according to claim 3 wherein the dumbbell support structure is a mechanical structure;

wherein the dumbbell support structure mounts on the mounting platform of the mounting bracket;

wherein the dumbbell support structure physically receives the one or more dumbbells for temporary storage on the weight bench;

wherein the dumbbell support structure physically elevates the one or more dumbbells above the supporting surface supporting the weight bench.

5. The strength training accessory according to claim 4 wherein the hinge is a rotating structure;

wherein the hinge attaches to the mounting platform of the mounting bracket such that the dumbbell support structure can be rotated to the storage position.

6. The strength training accessory according to claim 5 wherein the rotation assist structure is a mechanical structure;

wherein the rotation assist structure mounts on the mounting platform of the mounting bracket;

wherein the rotation assist structure stores rotational energy generated by rotation of the mounting platform of the mounting bracket from the storage position of the dumbbell support structure to a deployment position of the dumbbell support structure;

wherein the rotation assist structure mounts on the mounting bracket.

7. The strength training accessory according to claim 6 wherein the mounting bracket comprises a c-channel, a flat plate, and a plurality of bolts and nuts;

wherein the c-channel is a u-shaped mechanical structure;

wherein the c-channel is geometrically similar to the stanchion;

wherein a span of a length of an inner dimension of the c-channel is greater than a span of a length of an outer dimension of the stanchion such that the stanchion inserts into the c-channel;

wherein the flat plate is a perforated flat bar;

wherein a span of a length of a minor axis of the flat plate is lesser than the span of the length of the inner dimension of the c-channel such that the flat plate will press flush against the stanchion when the stanchion is inserted into the c-channel;

wherein each of the plurality of bolts and nuts is a fastening device comprising a bolt and a wing nut;

wherein each of the plurality of bolts and nuts secures the c-channel and the flat plate to the stanchion such that the stanchion elevates the strength training accessory above the supporting surface supporting the weight bench;

wherein each bolt from the plurality of bolts and nuts simultaneously inserts through an aperture formed through the c-channel, an aperture formed through the stanchion, and an aperture formed through the flat plate;

wherein each wing nut selected from the plurality of bolts and nuts screws onto a respective bolt such that the wing nut presses the flat plate against the stanchion such that the strength training accessory is fastened to the stanchion;

wherein the c-channel, the flat plate, and the plurality of bolts and nuts combine to form the load path that transfers the load of the mounting platform, the dumbbell support structure, and the one or more dumbbells to the stanchion.

8. The strength training accessory according to claim 7 wherein the mounting bracket further comprises the mounting platform;

wherein the mounting platform is a mechanical structure;

wherein the mounting platform attaches to an exterior surface of the lateral face of the c-channel of the mounting bracket;

wherein the dumbbell support structure attaches to the mounting platform;

wherein the hinge attaches to the mounting platform;

wherein the rotation assist structure attaches to the mounting platform.

9. The strength training accessory according to claim 8 wherein the individual db support further comprises a db support plate, a db mounting tenon, a db mounting mortise, and a cotterless pin;

wherein the db support plate is a chevron shaped structure;

wherein the db support plate forms the supporting surface on which the individual dumbbell selected from the one or more dumbbells rests when the dumbbell support structure is in the deployed position;

wherein the db mounting tenon is a perforated square tube structure that attaches to an interior surface of the db support plate;

wherein the db mounting tenon forms a tenon that secures the db support plate to the db mounting mortise;

wherein the db mounting tenon is geometrically similar to the db mounting mortise such that the db mounting tenon inserts into the db mounting mortise;

wherein the db mounting mortise is a perforated square tube structure that attaches to a superior surface of an exterior superior anterior square tubing;

wherein the db mounting tenon forms a mortise that secures the db support plate and the db mounting tenon to the db mounting mortise;

wherein the db mounting mortise is geometrically similar to the db mounting tenon such that the db mounting tenon inserts into the db mounting mortise to attach the db support plate to the exterior superior anterior square tubing of the mounting platform;

wherein the cotterless pin simultaneously inserts through the db mounting tenon and the db mounting mortise to secure the db support plate to the mounting platform.

10. The strength training accessory according to claim 9 wherein the mounting platform comprises an interior superior anterior square tubing, an interior superior posterior square tubing, an exterior superior anterior square tubing, the exterior superior posterior square tubing, and a bracing square tubing;

wherein the interior superior posterior square tubing is formed as a square tubing;

wherein the exterior superior anterior square tubing is formed as a square tubing;

wherein the bracing square tubing is formed as a square tubing.

11. The strength training accessory according to claim 10 wherein the rotation assist structure further comprises a hydraulic cylinder and a cylinder mounting structure;

wherein the cylinder mounting structure rigidly attaches the hydraulic cylinder to the exterior superior anterior square tubing;

wherein the cylinder mounting structure rigidly attaches the hydraulic cylinder to the exterior superior posterior square tubing.

12. The strength training accessory according to claim 11 wherein the dumbbell support structure further comprises an anterior db support and a posterior db support;

wherein the anterior db support is the individual db support that mounts on the superior surface of the exterior superior anterior square tubing of the mounting platform;

wherein the anterior db support is the individual db support of the dumbbell support structure that is distal from the hinge;

wherein the posterior db support is the individual db support that mounts on the superior surface of the exterior superior anterior square tubing of the mounting platform;

wherein the posterior db support is the individual db support of the dumbbell support structure that is proximal to the hinge;

wherein the posterior db support is identical to the anterior db support.

13. The strength training accessory according to claim 12 wherein an interior lateral face of the interior superior anterior square tubing lies next to but does not attaches to an exterior lateral face of the c-channel to form an offset lateral structure;

wherein an exterior lateral face of the interior superior anterior square tubing attaches to an interior lateral face of the exterior superior anterior square tubing to form a lateral structure;

wherein a span of a length of a center axis of the interior superior anterior square tubing is less than a span of a length of a center axis of the exterior superior anterior square tubing;

wherein an inferior lateral face of the interior superior posterior square tubing attaches to a superior lateral face of the bracing square tubing to form an offset lateral structure;

wherein the hinge attaches a superior lateral face of the interior superior anterior square tubing to an superior lateral face of the interior superior posterior square tubing such that the interior superior anterior square tubing rotates relative to the interior superior posterior square tubing;

wherein the hinge secures the interior superior anterior square tubing to the interior superior posterior square tubing such that the interior superior anterior square tubing and the interior superior posterior square tubing form a composite structure;

wherein the interior lateral face of the exterior superior anterior square tubing attaches to the exterior lateral face of the interior superior anterior square tubing to form a lateral structure;

wherein the dumbbell support structure mounts on a superior lateral face of the exterior superior anterior square tubing;

wherein an inferior lateral face of the exterior superior posterior square tubing attaches to the superior lateral face of the bracing square tubing to form an offset lateral structure;

wherein an interior lateral face of the exterior superior posterior square tubing attaches to an exterior lateral face of the interior superior posterior square tubing to form a lateral structure;

wherein the hinge attaches a superior lateral face of the exterior superior anterior square tubing to the superior lateral face of the exterior superior posterior square tubing such that the exterior superior anterior square tubing rotates relative to the exterior superior posterior square tubing;

wherein the hinge secures the exterior superior anterior square tubing to the exterior superior posterior square tubing such that the exterior superior anterior square tubing and the exterior superior posterior square tubing form a composite structure;

wherein the superior surface of the bracing square tubing attaches to the inferior lateral face of the interior superior posterior square tubing to form an offset lateral structure;

wherein the superior surface of the bracing square tubing attaches to the inferior lateral face of the exterior superior posterior square tubing to form an offset lateral structure;

wherein a lateral face of the bracing square tubing attaches to the exterior lateral face of the c-channel to form an offset lateral structure.

* * * * *